US005716288A

United States Patent [19]

Sacco

[11] Patent Number: 5,716,288

[45] Date of Patent: Feb. 10, 1998

[54] HEAD FOR GOLF CLUB IRONS

[75] Inventor: Thomas Salvatore Sacco, Longwood, Fla.

[73] Assignee: Thomas Golf, Inc., Altamonte Springs, Fla.

[21] Appl. No.: 668,940

[22] Filed: Jun. 24, 1996

[51] Int. Cl.[6] ..... A63B 53/04

[52] U.S. Cl. ..... 473/290; 473/314; 473/350

[58] Field of Search ..... 473/314, 324, 473/350, 287–291, 325–327, 329–340, 342–349

[56] References Cited

U.S. PATENT DOCUMENTS

| | | | |
|---|---|---|---|
| D. 90,924 | 10/1933 | Replogle | D21/219 |
| D. 207,227 | 3/1967 | Solheim | D21/217 |
| D. 208,984 | 10/1967 | Huelsman et al. | D21/217 |
| D. 210,789 | 4/1968 | Sprinker | 473/331 |
| D. 262,303 | 12/1981 | Kobayashi . | |
| D. 262,304 | 12/1981 | Kobayashi . | |
| D. 302,715 | 8/1989 | Petersen . | |
| D. 320,427 | 10/1991 | Antonious . | |
| D. 330,400 | 10/1992 | Antonious . | |
| D. 330,926 | 11/1992 | Antonious . | |
| D. 334,606 | 4/1993 | Cameron . | |
| D. 360,923 | 8/1995 | Antonious . | |
| D. 365,865 | 1/1996 | Antonious . | |
| D. 368,755 | 4/1996 | Blough et al. . | |
| 786,268 | 4/1905 | Corey et al. | 473/325 |
| 1,525,148 | 2/1925 | Pickop | 473/349 |
| 1,550,501 | 8/1925 | Byrne | 473/349 |
| 1,671,956 | 5/1928 | Sime . | |
| 2,088,095 | 7/1937 | Sargent et al. | 473/314 |
| 2,174,212 | 8/1939 | Newsome | 473/251 |
| 2,683,036 | 7/1954 | Klein | 473/349 |
| 3,020,048 | 2/1962 | Carroll | 473/324 |
| 3,077,350 | 2/1963 | Koorland | 473/251 |
| 3,088,736 | 5/1963 | Mospan | 473/314 |
| 3,360,268 | 12/1967 | Molinari | 473/244 |
| 3,595,582 | 7/1971 | Chapman | 473/244 |
| 3,858,886 | 1/1975 | Cosby | 473/350 |
| 3,923,308 | 12/1975 | Mills | 473/254 |
| 3,947,041 | 3/1976 | Barber | 473/314 |
| 3,981,507 | 9/1976 | Nunziato | 473/327 |
| 3,995,864 | 12/1976 | Cochran et al. | 473/337 |
| 4,128,244 | 12/1978 | Duclos | 473/242 |
| 4,211,416 | 7/1980 | Swanson | 473/242 |
| 4,345,763 | 8/1982 | Swanson | 473/242 |
| 4,787,636 | 11/1988 | Honma | 473/349 |
| 4,900,028 | 2/1990 | Antonious | 473/242 |
| 4,907,806 | 3/1990 | Antonious . | |
| 4,919,431 | 4/1990 | Antonious | 473/350 |
| 5,067,711 | 11/1991 | Parente | 473/314 |
| 5,120,062 | 6/1992 | Scheie | 473/350 |
| 5,273,282 | 12/1993 | Cannon | 473/252 |
| 5,401,021 | 3/1995 | Allen | 473/291 |
| 5,447,307 | 9/1995 | Antonious | 473/350 |
| 5,540,437 | 7/1996 | Bamber | 473/327 |
| 5,588,923 | 12/1996 | Schmidt | 473/324 |

FOREIGN PATENT DOCUMENTS 1 232 651 of 0000 United Kingdom .

*Primary Examiner*—Sebastiano Passaniti
*Assistant Examiner*—Stephen L. Blau
*Attorney, Agent, or Firm*—Bell Seltzer Intellectual Property Law Group of Alston & Bird LLP

[57] ABSTRACT

A head for a golf club iron is disclosed that provides a top planar surface for triaxial alignment of a planar striking surface substantially perpendicular to the intended path of the ball, so that the loft angle of the planar striking surface with respect to the ball matches a preselected loft angle, and so that the lie of the club from toe to heel is balanced. The top planar surface and the planar striking surface of the club face define an angle between them equal to the preselected loft angle for the planar striking surface plus 90°. The back surface of the club intersects the top planar surface to define a sighting edge that is rearwardly extended from the trailing top edge of the club face for alignment of the club face perpendicular to the intended path of the ball. The top planar surface is of substantially uniform width from toe to heel and the loft and lie of the club are adjusted by holding the top planar surface horizontal.

26 Claims, 2 Drawing Sheets

HEAD FOR GOLF CLUB IRONS

FIELD OF THE INVENTION

This invention relates to golf club irons. More specifically, this invention relates to improvements in the design of golf club irons to increase the accuracy and finesse with which a golf ball is hit and placed on a green.

BACKGROUND OF THE INVENTION

Golf is a game in which clubs typically with wooden or metal heads are used to hit a small, white ball having a tough cover and a resilient core into a number of holes, usually 9 or 18, in succession, situated at various distances over a course having natural or artificial obstacles, the object being to get the ball into each hole in as few strokes as possible. There are several types of golf clubs that are used for hitting the ball in the game of golf. Irons, woods, and putters are the most commonly used clubs among these.

Putters are flat-bladed clubs that are designed for short shots on a green. The green is an area of smooth, fine grass that contains the hole into which it is desired to place the ball. The putter typically has a relatively short, stiff shaft and a wooden, ceramic, iron, or steel head. The putter head generally is flat bladed, which is to say that the loft of the club is approximately zero. The loft refers to the slope of the face of the head of the club backward from the vertical. Loft tends to drive the ball upward. In putting, it is not desired to loft the golf ball into the air, but to use the contours of the green in combination with the prevailing green conditions to place the ball in the hole.

Woods, including the driver, brassie, spoon, cleek, and baffy, typically are used for shots where distance is more important that accuracy. Woods traditionally were made from wood, although today's woods may also be made from various materials including titanium, graphite, or combinations of various materials. The heads of woods are larger and thicker than those of irons and putters and may be shaped in a variety of ways. The face of the head of a wood typically is sloped back to some degree, although usually less than that for irons, to provide some loft to the ball. However, the club is designed usually to hit the ball from a tee, which is a small, short peg used to elevate the ball above the teeing ground. The teeing ground, where woods are usually used, is the starting place for play of a particular hole. Thereafter, irons typically are used to place the ball on the green.

Irons, which once were made exclusively of iron and are now usually made from steel, typically are used for shots that require finesse and accuracy, rather than the brute power with which a wood is used. However, the shots are usually longer than are hit with a putter and the ball is lofted to avoid obstacles and for distance. Irons usually come in a set numbered 1 through 9 where the numbers refer to the club loft angle. The higher the number, the greater the loft angle.

Irons 1 through 9 typically have loft angles of from 16° to 47° progressing from 1 through 9. Some irons, known as "zero loft irons," have loft angles of about 10° to 12°. Flatter bladed club heads are better for distance shots, while more angled club heads are used for shorter shots with increased accuracy. Generally speaking, the lower the loft angle, the farther the ball will travel when hit with the club as compared to other clubs of a greater loft angle.

A set of irons can also include a pitching wedge, gap wedge, sand wedge, and lob wedge, which are usually used for getting the ball out of roughs and bunkers or over steep portions of fairway when approaching an elevated green. Wedges may have loft angles of from about 48° to 66°.

Golf is basically a target game. A number of modifications have been proposed to the basic club designs discussed above to decrease the number of strokes required to transport the ball from the teeing ground to the hole in the green. Many ideas have been proposed to increase the accuracy of irons. A plethora of patents has issued in the golf club art over a number of years relating to changes in the design of irons.

For example, Swanson U.S. Pat. No. 4,211,416 proposes a golf club iron that has the top surface of the head at an angle to the bottom surface in the face plane of the club in which the toe of the club flares upwardly and outwardly at an angle to the bottom edge defined by the sole and face when viewed from the address position. The head is provided with a flange or ledge projecting rearwardly from the top edge of the head, extending substantially along the entire length from toe to heel, and increasing in width from toe to heel to define a rear sighting edge. The rear sighting edge is parallel with the bottom front edge of the golf club head. The sighting edge is said to permit the golfer to align the face normal to the intended flight path of the ball when the bottom edge of the head is obscured by turf.

The hosel, which is the socket in the head of an iron that receives the golf club shaft, is fixed to the club head so that the longitudinal axis of the shaft passes through the same plane as the "sweet spot," which is the desired center of percussion for hitting a golf ball.

Swanson U.S. Pat. No. 4,345,763 discloses a thin sighting line for lofted golfing irons of the type referred to in Swanson U.S. Pat. No. 4,211,416, but is said to eliminate the rearwardly extending ledge. The Swanson '763 patent discloses a sighting edge formed along the topmost portion of a golf club head of substantially rectangular configuration. The club of the Swanson '763 patent is said to have a top edge that is thin and provides a true sight line when addressing the ball that is not obscured by the back face of the club.

The back of the head of the club disclosed in the Swanson '763 patent extends vertically from a back bottom edge of the thick sole to a ridge that is inclined from near the top of the toe to a level about flush with the top end of the hosel at the heel. The hosel is connected by a flattened wide land to the lower portion of the heel. In one embodiment, a rounded bevel or fillet merges the ridge into a thin top portion of the club head. With the rectangular configuration of the club face, the thin top edge is said to be parallel to the bottom edge of the club defined by the intersection of the face and sole of the club.

The Swanson clubs are not perimeter weighted clubs, which typically are preferred. The club of the '763 patent has been criticized as non-traditional in shape and in weight distribution and strikeability characteristics in Antonious U.S. Pat. No. 4,900,028. The Antonious '028 patent discloses a golf club head having a diverging angular top ridge that extends upwardly and outwardly from the hosel toward the toe of the golf club head. A sighting section is included on the upper portion of the top ridge that is perpendicular to the intended flight path of the ball and is parallel to the longitudinal axis between the heel and toe of the club face. The upper toe portion of the club head is substantially parallel to the sole of the club head and is therefore substantially horizontal to the ground when the club head is addressed to the ball.

Antonious U.S. Pat. No. 5,447,307 discloses a golf club with an anchor-back hosel wherein the lower section of the hosel extends beyond and away from the heel portion of the club and is anchored to the back of the club head to provide added weight. The shaft socket in the hosel is said to extend downward to a point approximately aligned with the club head longitudinal axis that extends from the heel to the toe and intersects with the club head center of gravity.

As is apparent from the extent of the golf club art, modifications in club head design can produce significant changes in the use of the clubs and in accuracy and hitting distance. New materials for golf club heads, shafts, and balls can have a tremendous impact on whether one club design is preferred above another. For example, expensive titanium woods, of increasing popularity, offer a variety of characteristics not seen in woods of prior materials, such as lightweight, large club head and striking surface size, strength, and hardness that have a significant impact on the design and hitting characteristics of golf clubs.

Despite the plethora of golf club designs, new balls, and changes in materials that have occurred over the years, many golfers still have difficulty perfecting their aim and using their golf clubs to their best ability. The golf club swing is somewhat unnatural and requires intense concentration to perfect and use consistently. However, it is generally agreed that the striking surface of the iron should be perpendicular to the ball at the point of impact and that the loft and lie of the club should be adjusted to provide the best results. The preselected loft of an iron determines how high and how far a particular golf ball will be hit compared to another club of similar design and materials but of a different loft. It is also generally considered desirable to hold the club level with respect to the ground, which is to say that the lie of the club from toe to heel should properly be adjusted in the address position.

One problem that arises is that many golfers typically learn their own set of clubs, which is to say that the individual golfer's particular habits usually influence the accuracy, height, and distance a golf ball travels in addition to the loft and lie angles actually assigned to a set of clubs. Many players adjust the loft and lie angles of a club by the particular manner in which they hold the club and thereby affect the path of travel of the ball. Custom shops sometimes change the angle at which the hosel enters the club head to adjust for the golfer's peculiar habits that may affect the lie of the club when the ball is addressed.

Many golf club designs address one or more of these problems with more or less success. However, the problems persist of accurately and consistently controlling direction, loft, and lie.

SUMMARY OF THE INVENTION

This invention is a head for a golf club iron having a new design that provides for greater accuracy and control of direction, loft, and lie in the game of golf. The invention provides a golf club iron having a substantially rectangular, lofted, planar striking surface with a top planar surface of substantially uniform width extending from toe to heel. The top planar surface intersects the back surface to define a rearwardly extended sighting edge that is parallel to the planar striking surface. The top planar surface, including the rearwardly extended striking surface, is useful for triaxial alignment of the club head in the address position for controlling direction, loft, and lie, in a club having, as described below in connection with the various aspects of the invention, features providing for a preferred weight distribution and striking surface, even for titanium irons.

In one aspect, the invention comprises a head for a golf club iron having a sloped-back club face with a leading bottom edge, a trailing top edge, and toe and heel portions that are substantially of the same height. The toe and heel portions join the bottom and top edges and define a planar striking surface of substantially rectangular configuration. The planar striking surface has a preselected loft angle. A sole extends rearwardly from the leading bottom edge of the club face. A top planar surface of substantially uniform width extends from the toe to the heel and also extends rearwardly from the trailing top edge of the sloped-back club face. A back surface of the golf club iron has a lower portion that intersects the rearwardly extending sole and defines an edge between the sole and the back surface. An upper portion of the back surface intersects the rearwardly extending top planar surface and defines a sighting edge. The sighting edge is rearwardly extended from the trailing top edge and extends from the toe to the heel parallel to the planar striking surface. The rearwardly extended sighting edge provides for adjusting the striking surface perpendicular to the intended path of the ball. The golf club head also includes a hosel extending from the heel.

In another aspect, the top planar surface and the planar striking surface of the club face define an angle between them that is equal to the preselected loft angle to the planar striking surface plus 90°. This relationship holds true for each club in a set. When the club head is in the address position, then the top planar surface is substantially perpendicular to the intended path of the ball, horizontal from the toe to the heel, and horizontal from the trailing front edge to the rearwardly extended rear sighting edge. The top planar surface and the rearwardly extended rear sighting edge thereby provide for triaxial alignment of the club head.

When the club head is in triaxial alignment, then the planar striking surface is perpendicular to the intended path of the ball, the loft angle of the planar striking surface with respect to the ball matches the preselected loft angle, and the lie of the club from toe to heel is balanced. The golfer can adjust the top planar surface and the rear sighting edge by sight.

In another aspect of the invention, the club head is a perimeter weighted club head and the upper and lower portions of the back surface of the club head define a cavity between them. The lower portion of the back surface that intersects the rearwardly extending sole defines an edge that is a peripheral weighted portion. This weighted portion progressively becomes thicker from heel to toe so that the sole progressively becomes wider from heel to toe. The back surface lower portion provides substantial peripheral weight progressing from the heel to the toe.

The upper portion is also a peripheral weighted portion, but of substantially reduced weight compared to the lower portion. The upper portion is of substantially uniform thickness from heel to toe so that the top planar surface is of substantially uniform width. The rear sighting edge is parallel to the planar striking surface of the club face and the upper portion of the back surface overhangs the cavity on the back of the club.

In still another aspect of the invention, the hosel comprises an upper, substantially cylindrical socket for receiving a golf club shaft and a lower transition region whereby the hosel is joined to the heel and sole. The golf club head has a longitudinal axial plane passing through the center of percussion of the club head in the toe to heel direction. The shaft receiving socket terminates at the intersection of the socket with the longitudinal axial plane forward of the club face.

Thus, among other features, the invention provides a golf club iron having the hitting characteristics of a perimeter weighted club that can be easily visually aligned by a golfer along three different axes for control over the accuracy and distance with which a ball is hit. Consistent control over the loft angle, lie, and direction of travel of the ball are keys to consistent success in the game of golf.

BRIEF DESCRIPTION OF THE DRAWINGS

Some of the features and advantages of the invention have been stated. Other advantages will become apparent as the description of the invention proceeds taking into conjunction the accompanying drawings, in which.

DETAILED DESCRIPTION OF THE INVENTION

The invention will now be described more fully with reference to the accompanying drawings, which illustrate a preferred embodiment of the invention.

Figure 1:
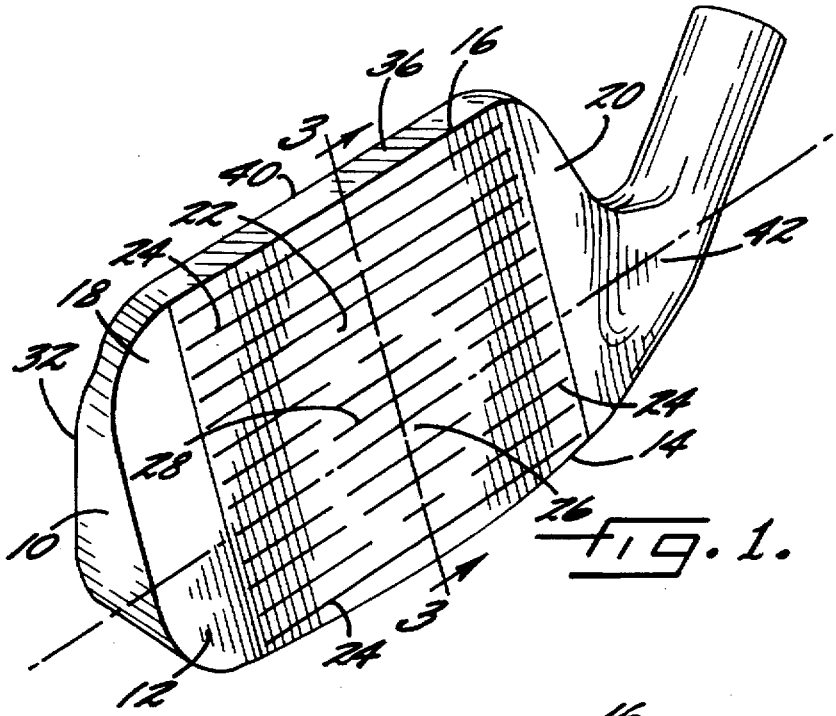
FIG. 1 illustrates a front perspective view of a head for a golf club iron of the invention.

Illustrated in FIG. 1 is a perspective front view of a head 10 for a golf club iron in accordance with the invention. The golf club head has a sloped-back club face 12 having a leading bottom edge 14, a trailing top edge 16, and toe and heel portions 18 and 20, respectively, that are of substantially the same height joining the bottom and top edges. The sloped-back club face has a preselected loft angle, which is the angle of the slope of the club face back from the vertical. The club of FIG. 1 has a loft angle of approximately 24.5°, which would typically be designated a four iron.

The bottom edge, trailing top edge, and toe and heel portions define a planar striking surface 22 of substantially rectangular configuration. The planar striking surface has a plurality of parallel grooves 24 in the club face for imparting the desired spin to the golf ball. These grooves typically are painted in contrasting color from the club face so as to be more easily discernible and to provide a pleasing appearance. The striking surface may also etched to have a frosted appearance. The "sweet spot", shown as 26, which is the center of percussion of the club face at which it is most desirable to impact a golf ball for the greatest control over accuracy and distance, is marked with separate grooves 28, which may be of a contrasting color from the other grooves of the striking face.

Figure 6:
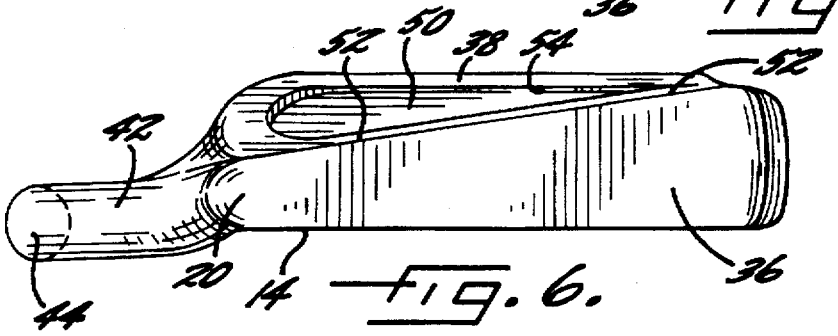
FIG. 6 illustrates a bottom plan view of the club head.

A sole 30 extends rearwardly from the leading bottom edge 14 of the club face, as also shown in FIGS. 3, 4, 6, and 7. The sole extends rearwardly from the leading bottom edge of the club face and intersects the back surface 32 of the club at a lower portion thereof 34. As shown in FIG. 6, the sole becomes progressively wider from heel to toe.

Figure 2:
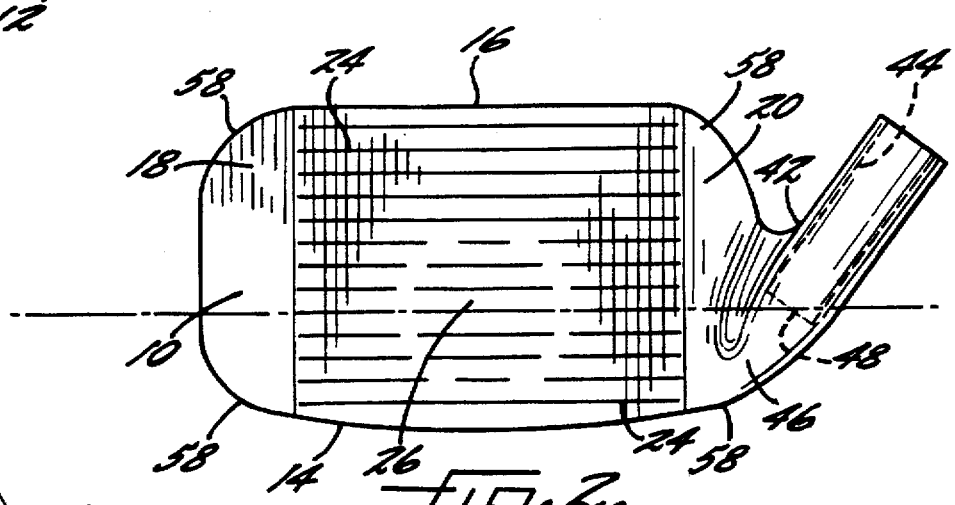
FIG. 2 illustrates a front plan view of the club head.

The sole typically is curved in the longitudinal and transverse directions to facilitate movement of the club through grass in the manner of premium clubs. However, the curved sole can be somewhat expensive to make and is not always included in the manufacture of golf clubs. The sole shown in FIG. 2 is curved about 240° along the arc of a circle in the longitudinal direction. Typically, the sole can be curved longitudinally along the arc of a circle of from less than about 130° to 250° or more. The sole shown in FIG. 3 is curved transversely from front to back along the arc of a circle of about 60°.

The club head also includes a top planar surface 36 of substantially uniform width that extends from toe to heel. The top planar surface extends rearwardly from the trailing top edge 16 of the sloped-back club face. The rearwardly extending top planar surface intersects the back surface at an upper portion 38 of the back surface and defines a sighting edge 40 that extends rearwardly from the trailing top edge. The sighting edge extends from toe to heel parallel to the planar striking surface 22 of the club face and provides a sighting edge for adjusting the striking surface perpendicular to the intended path of the ball.

Figure 3:
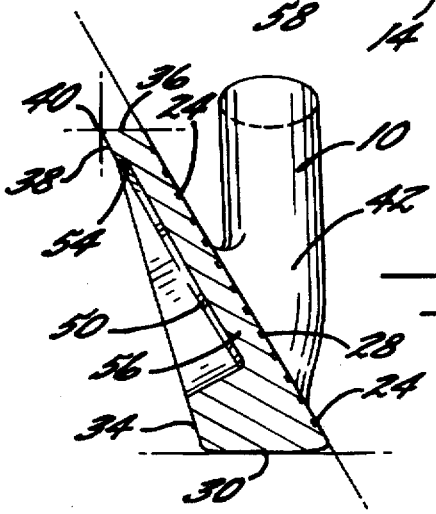
FIG. 3 illustrates a transverse section through the club head taken along line 3—3 of FIG. 1.
Figure 7:
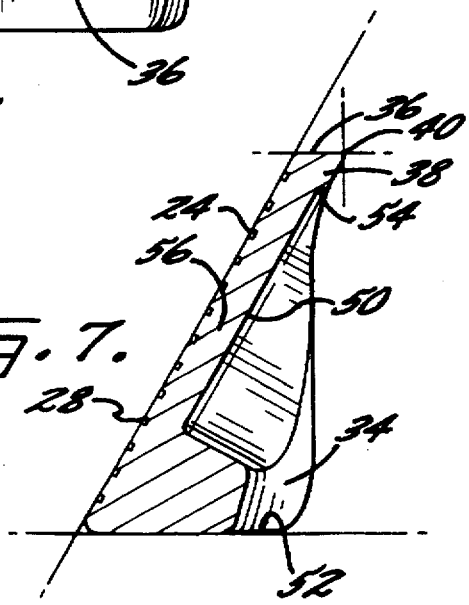
FIG. 7 illustrates a transverse section through the club head taken along line 7—7 of FIG. 4 and in the opposite direction along the longitudinal axis of the section illustrated in FIG. 3.

The top planar surface 36 and the planar striking surface 22 of the club face 12 define an angle between them that is equal to the preselected loft angle for the planar striking surface plus 90°, as shown in FIGS. 3 and 7. The relationship between the top planar surface and the planar striking surface holds for each club in a complete set, which typically would include irons one through nine, and can also include various wedges.

The preselected loft angle corresponds to that for a club face planar striking surface that is selected from the group consisting of irons one through nine, a pitching wedge, a gap wedge, a sand wedge, and a lob wedge. The preselected loft angle for the planar striking surface typically will be from about 10° for a "zero lofted iron" iron to about 66° for a lob wedge having a high degree of loft.

One irons, which sometimes are also referred to as cleeks or driving irons, have lofts from about 16° to 18°. The two iron or mid iron typically has a loft of from about 18° to 21°. The three iron or mid mash typically has a loft angle of from about 21° to 24°. The four iron or mashie iron typically has a loft angle of from about 24.5° to 27°. The five iron or mashie typically has a loft angle of from about 28° to 31°. The six iron or spade mashie typically has a loft angle of from about 32° to 35°. The seven iron or mashie niblick typically has a loft angle of from 36° to 39°. The eight iron or lofter typically has a loft angle of from 40° to 43°. The nine iron, which is also referred to as the niblick, typically has a loft angle of from 44° to 47°.

The wedges are highly lofted clubs for special uses in delivering a ball accurately over hazards and out of bunkers and can have loft angles that vary from about 48° to 66°. Pitching wedges typically have loft angles of from about 48° to 51°. Gap wedges fill the gap between pitching wedges and sand wedges and typically have loft angles of from about 52° to 55°. Sand wedges typically have loft angles of from about 56° to 59°. Lob wedges typically have loft angles of from about 60° to 66°.

The golf club head also has a hosel 42 extending from the heel. The sole, heel, club face, and back surface of the club all come together to form a smooth transition into the hosel. The hosel is that portion of the golf club head that comprises a socket 42 into which a golf club shaft may be inserted. As shown in FIG. 1 and in FIGS. 2 and 3, the hosel extends upwardly and outwardly from the heel adjacent the sole 30 and forward from the planar striking surface 22. The acute angle between the longitudinal axis through the hosel and a vertical axis through the club head from top to bottom defines the angle of the lie of the club from toe to heel when the club is in the address position.

The hosel 42 also extends forward from the planar striking surface 22 at an angle to the planar striking surface as is shown in FIG. 3. In the case of the four iron illustrated in FIG. 2, the hosel is offset from the club face and is in front of the leading bottom edge 14 by a distance of about 3 mm. Typically, a set of clubs will have a progressive offset of from about 4 mm to 0. However, it should be recognized that some club sets are manufactured with no offset whatsoever. The offset is considered to assist the amateur player in maintaining his hand forward of the club face at impact.

The hosel comprises an upper, substantially cylindrical socket 44 for receiving the golf club shaft and a lower transition region 46 whereby the hosel is joined to the heel and sole. The termination point 48 of the socket in the hosel for receiving the shaft is shown in shadow in FIG. 2. The end of the shaft inserted into the hosel of FIG. 2 would terminate at a point aligned with a longitudinal axis through the club center of gravity, which is also called the "sweet spot" or the "center of percussion" and is shown at 26. A longitudinal axial plane extending through the sweet spot would be intersected at the termination point 48 of the shaft in the socket. This feature is believed to promote a better transfer of power from the downswing through impact by making full use of the lever arm of the golf club handle.

Figure 5:
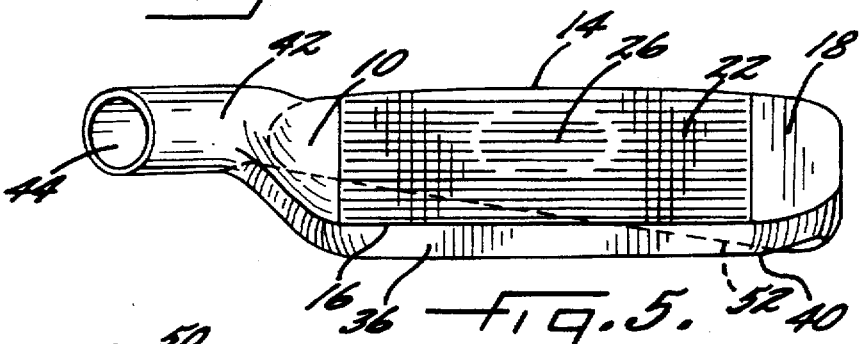
FIG. 5 illustrates a top plan view of the club head.

The plane of the top planar surface 36 is shown in FIGS. 1 and 5. The plane extends from toe to heel and from the trailing top edge 16 to the rearwardly extended sighting edge 40. As shown in FIG. 3, when the club is held in the address position and at the proper lie angle (FIG. 2), then the top planar surface is substantially perpendicular to the intended path of the ball, is horizontal from toe to heel, and is also horizontal from the trailing front edge to the rearwardly extended rear sighting edge. This arrangement provides for triaxial alignment of the club head for preservation of direction, loft, and lie.

When the club head is in triaxial alignment, then the planar striking surface 22 is perpendicular to the intended path of the ball, the loft angle of the planar striking surface with respect to the ball matches the preselected loft angle, and the lie of the club from toe to heel is balanced. In particular, the rearwardly extended rear sighting edge 40 is perpendicular to a vertical through the club head. Accordingly, if the club head is held with the rear sighting edge perpendicular to the intended direction of travel of the ball, then a more square impact shot is likely to result.

The golfer can also adjust the top planar surface by sight from the front of the club to the back. The light reflective qualities of the top planar surface of the club enable the golfer to visually see when the club is held at the proper loft angle. The top planar surface tends to reflect light to the eyes more intensely when horizontal. It should be recognized that the top planar surface can be etched if desired, which may enhance the loft controlling characteristics.

The lie of the club from toe to heel is balanced by adjusting the club from the toe to the heel so that the top planar surface lies horizontal. Since the top planar surface is substantially the same height from the toe to the heel, the light reflective qualities of the top planar surface have a similar effect when adjusting the lie from toe to heel as when adjusting the angle of loft from the front planar surface to the back surface. Thus, the player can quickly and visually observe the direction, loft, and lie of the club simultaneously.

The golf club as illustrated is a perimeter weighted club head. Originally, club heads were called blades, largely because they were flat on both sides and were forged. Perimeter weighted clubs typically are cast and are made of stainless steel. A perimeter weighted club has a mass of metal extended from the back surface thereof to provide favorable weight characteristics for the particular club.

Figure 4:
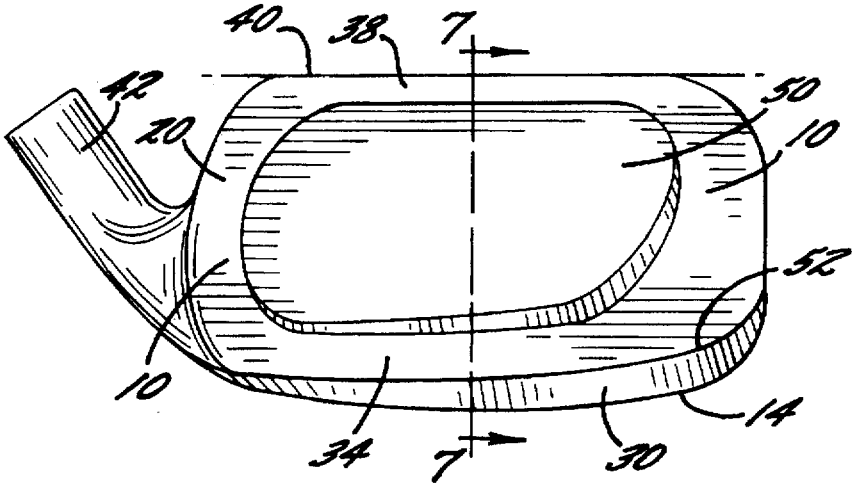
FIG. 4 illustrates a plan view of the back surface of the club head of the invention.

Turning now to FIG. 4, the perimeter weighted club head of the invention is shown with upper and lower portions 38 and 34, respectively, of a back surface. The upper and lower portions of the back surface of the club define a cavity 50 therebetween, as shown also in FIGS. 3 and 7. The back surface lower portion intersects with the rearwardly extended sole and defines an edge 52 between them.

The back surface lower portion is a peripheral weighted portion that becomes progressively thicker from the heel to the toe. As shown in FIG. 6, the sole 30 progressively becomes wider from heel to toe and the back surface lower portion 34 provides substantial peripheral weight progressing from the heel to the toe.

The upper portion 38 of the back surface of the club head is a peripheral weighted portion of substantially reduced weight compared to the lower portion and of substantially uniform thickness from heel to toe so that the top planar surface is of substantially uniform width. The rear sighting edge is parallel to the planar striking surface and the top planar surface does not form a thin edge, but provides an overhang 54 to the cavity.

The cavity portion 50 of the back surface of the club head results in a club head of substantially uniform width between the club face and the back surface that is defined by the cavity. The back surface defined by the cavity can bear printed indicia such as trademarks or other information concerning the golf club. The uniform width portion 56 defined by the cavity can be seen in FIGS. 3 and 7.

The invention is particularly useful when applied to a perimeter weighted club. Perimeter weighted clubs, which are sometimes called "cavity back" clubs typically are cast from materials such as stainless steel. 17-4 stainless steel is a grade commonly used for premium clubs.

Titanium, which is forty percent lighter than stainless steel, is more difficult to cast into a club because it can be somewhat difficult to achieve the weighting characteristics of a stainless steel club. However, the design of the invention is particularly useful for preparation of clubs from titanium. The rearwardly extended sighting edge 40 and top planar surface 36 provides a very convenient location for the placement of additional weight in a titanium club head. The top planar surface typically will be 5 mm wide or more wide for a stainless steel club and can be produced in even wider widths for the titanium club of up to about 10 mm or more if desired.

The invention should also be useful in the preparation of forged irons, which are sometimes called blades because of the absence of perimeter weighting. The blade can be forged with the top planar surface of the invention and rearwardly extended sighting edge.

FIGS. 2 and 4 illustrate from the front and the back of the club that the heel and toe are each joined to the sole and to the top planar surface through radiuses 58 so that the club is provided with smooth edges and a desirable appearance.

The foregoing description is to be considered illustrative rather than restrictive of the invention. While this invention has been described in relation to its specific embodiments, it is to be understood that various modifications thereof will be apparent to those of ordinary skill in the art on reading the specification and it is intended to cover all such modifications that come within the meaning and range of equivalence of the appended claims.

What is claimed is:

1. A head for a golf club iron comprising:

a) a sloped-back club face having a leading bottom edge, a trailing top edge, and toe and heel portions of substantially the same height joining said bottom and top edges and defining a planar striking surface of substantially rectangular configuration and having a preselected loft angle;

b) a sole extending rearwardly from said leading bottom edge of said club face;

c) a top planar surface of substantially uniform width extending from toe to heel and rearwardly from said trailing top edge;

d) a back surface having a lower portion intersecting said rearwardly extending sole and an upper portion intersecting said rearwardly extending top planar surface and defining a sighting edge rearwardly extended from said trailing top edge and extending from toe to heel parallel to said planar striking surface of said club face for adjusting said striking surface perpendicular to the intended path of the ball, said top planar surface being wider than the smallest distance between said club face and said back surface; and e) a hosel extending from said heel.

2. The golf club head of claim 1 wherein said top planar surface and said planar striking surface of said club face define an angle between them equal to the preselected loft angle for said planar striking surface plus 90 degrees.

3. The golf club head of claim 2 wherein when said club head is in the address position, then said top planar surface is substantially perpendicular to the intended path of the ball, horizontal from toe to heel, and horizontal from said trailing front edge to said rearwardly extended rear sighting edge for triaxial alignment of said club head wherein when said club head is in triaxial alignment, then said planar striking surface is perpendicular to the intended path of the ball, the loft angle of the planar striking surface with respect to the ball matches the preselected loft angle, and the lie of the club from toe to heel is balanced.

4. The golf club head of claim 1 wherein said preselected loft angle corresponds to that for a club face planar striking surface selected from the group consisting of irons 1 through 9, a pitching wedge, a gap wedge, a sand wedge, and a lob wedge.

5. The golf club head of claim 1 wherein said preselected loft angle for said planar striking surface is from about 10 to 66 degrees.

6. The golf club head of claim 1 wherein said hosel extends upwardly and outwardly from said heel adjacent said sole and forward from said planar striking surface.

7. The golf club head of claim 6 wherein said hosel comprises an upper, substantially cylindrical socket for receiving a golf club shaft and a lower transition region whereby said hosel is joined to said heel and sole, and wherein said golf club head has a longitudinal axial plane passing through the center of percussion of said club head in the toe to heel direction and wherein said shaft receiving socket terminates at the intersection of said socket with said longitudinal axial plane forward of said club face.

8.) The golf club head of claim 1 wherein said club head is a perimeter weighted club head and said upper and lower portions of said back surface of said club head define a cavity therebetween, and wherein said back surface lower portion is a peripheral weighted portion that progressively becomes thicker from heel to toe so that said sole progressively becomes wider from heel to toe and said back surface lower portion provides substantial peripheral weight progressing from said heel to said toe, wherein said upper portion is a peripheral weighted portion of substantially reduced weight compared to said lower portion and of substantially uniform thickness from heel to toe so that said top planar surface is of substantially uniform width and said rear sighting edge is parallel to said planar striking surface of said club face, and wherein said top planar surface overhangs said cavity.

9. The golf club head of claim 8 wherein said cavity provides a club head of substantially uniform width between said club face and said back surface defined by said cavity.

10. The golf club head of claim 9 wherein said back surface defined by said cavity bears printed indicia.

11. The golf club head of claim 1 wherein said top planar surface is about 5 mm or more wide.

12. A head for a golf club iron comprising:

a) a sloped-back club face having a leading bottom edge, a trailing top edge, and toe and heel portions of substantially the same height joining said bottom and top edges and defining a planar striking surface of substantially rectangular configuration and having a preselected loft angle;

b) a sole extending rearwardly from said leading bottom edge of said club face;

c) a top planar surface of substantially uniform width extending from toe to heel and rearwardly from said trailing top edge, wherein said top planar surface and said planar striking surface of said club face define an angle between them equal to said preselected loft angle for said planar striking surface plus 90 degrees, and wherein said preselected loft angle is from 16 to 56 degrees;

d) a back surface having a lower portion intersecting said rearwardly extending sole and defining an edge therebetween and an upper portion intersecting said rearwardly extending top planar surface and defining a sighting edge rearwardly extended from said trailing top edge and extending from toe to heel parallel to said planar striking surface of said club face for adjusting said striking surface perpendicular to the intended path of the ball, said top planar surface being wider than the smallest distance between said club face and said back surface; and e) a hosel extending from said heel and having an upper, substantially cylindrical socket for receiving a golf club shaft and a lower transition region whereby said hosel is joined to said heel and sole, wherein said golf club head has a longitudinal axial plane passing through the center of percussion of said club head in the toe to heel direction, and wherein said shaft receiving socket terminates at the intersection of said socket with said longitudinal axial plane forward of said club face.

13. A head for a perimeter weighted golf club iron comprising:

a) a sloped-back club face having a leading bottom edge, a trailing top edge, and toe and heel portions of substantially the same height joining said bottom and top edges and defining a planar striking surface of substantially rectangular configuration and having a preselected loft angle;

b) a sole extending rearwardly from said leading bottom edge of said club face, said sole progressively becoming wider from heel to toe;

c) a top planar surface of substantially uniform width extending from toe to heel and rearwardly from said trailing top edge;

d) a back surface having a lower peripheral portion intersecting said rearwardly extending sole said lower peripheral portion progressively becoming thicker from heel to toe and providing substantial peripheral weight progressing from heel to toe, an upper peripheral portion of substantially reduced weight compared to said lower portion and intersecting said rearwardly extending top planar surface and defining a rear sighting edge rearwardly extended from said trailing top edge and extending from toe to heel parallel to said planar striking surface of said club face for adjusting said striking surface perpendicular to the intended path of the ball, and wherein said upper and lower portions of said back surface define a cavity therebetween; and e) a hosel extending upwardly from said heel adjacent said sole and forward from said club face.

14. The perimeter weighted golf club head of claim 13 wherein said club is cast from titanium.

15. The perimeter weighted golf club head of claim 13 wherein when said club head is in the address position, then said top planar surface is substantially perpendicular to the intended path of the ball, horizontal from toe to heel, and horizontal from said trailing front edge to said rearwardly extended rear sighting edge for triaxial alignment of said club head wherein when said club head is in triaxial alignment, then said planar striking surface is perpendicular to the intended path of the ball, the loft angle of the planar striking surface with respect to the ball matches the preselected loft angle, and the lie of the club from toe to heel is balanced.

16. The golf club head of claim 13 wherein said top planar surface and said planar striking surface of said club face define an angle between them equal to the preselected loft angle for said planar striking surface plus 90 degrees.

17. The golf club head of claim 13 wherein said preselected loft angle corresponds to that for a club face planar striking surface selected from the group consisting of irons 1 through 9, a pitching wedge, a gap wedge, a sand wedge, and a lob wedge.

18. The golf club head of claim 13 wherein said preselected loft angle for said planar striking surface is from about 10 to 66 degrees.

19. The golf club head of claim 13 wherein said cavity provides a club head of substantially uniform width between said club face and said back surface defined by said cavity.

20. The golf club head of claim 13 wherein said hosel extends upwardly and outwardly from said heel adjacent said sole and forward from said planar striking surface.

21. The golf club head of claim 20 wherein said hosel comprises an upper, substantially cylindrical socket for receiving a golf club shaft and a lower transition region whereby said hosel is joined to said heel and sole, and wherein said golf club head has a longitudinal axial plane passing through the center of percussion of said club head in the toe to heel direction and wherein said shaft receiving socket terminates at the intersection of said socket with said longitudinal axial plane forward of said club face.

22. The golf club head of claim 13 wherein said sole is curved to facilitate unrestricted movement of the club head through grass.

23. The golf club head of claim 13 wherein said heel and toe are joined to said sole and said top planar surface through radiuses.

24. A head for a perimeter weighted golf club iron comprising:

a) a sloped-back club face having a leading bottom edge, a trailing top edge, and toe and heel portions of substantially the same height joining said bottom and top edges and defining a planar striking surface of substantially rectangular configuration and having a preselected loft angle;

b) a sole extending rearwardly from said leading bottom edge of said club face, said sole progressively becoming wider from heel to toe, and wherein said sole is curved to facilitate unrestricted movement of the club head through grass;

c) a top planar surface of substantially uniform width extending from toe to heel and rearwardly from said trailing top edge, wherein said top planar surface and said planar striking surface of said club face define an angle between them equal to said preselected loft angle for said planar striking surface plus 90 degrees, and wherein said preselected loft angle is preselected from the group consisting of irons 1 through 9, a pitching wedge, and a sand wedge;

d) a back surface having a lower peripheral portion intersecting said rearwardly extending sole, said lower peripheral portion progressively becoming thicker from heel to toe and providing substantial peripheral weight progressing from heel to toe, an upper peripheral portion of substantially reduced weight compared to said lower portion and intersecting said rearwardly extending top planar surface and defining a rear sighting edge rearwardly extended from said trailing top edge and extending from toe to heel parallel to said planar striking surface of said club face for adjusting said striking surface perpendicular to the intended path of the ball, and wherein said upper and lower portions of said back surface define a cavity therebetween, said top planar surface overhanging said cavity; and e) a hosel extending upwardly from said heel adjacent said sole and forward from said club face, said hosel having an upper, substantially cylindrical socket for receiving a golf club shaft and a lower transition region whereby said hosel is joined to said heel and sole, and wherein said golf club head has a longitudinal axial plane passing through the center of percussion of said club head in the toe to heel direction and wherein said shaft receiving socket terminates at the intersection of said socket with said longitudinal axial plane forward of said club face; wherein when said club head is in the address position, then said top planar surface is substantially perpendicular to the intended path of the ball, horizontal from toe to heel, and horizontal from said trailing front edge to said rearwardly extended rear sighting edge for triaxial alignment of said club head wherein when said club head is in triaxial alignment, then said planar striking surface is perpendicular to the intended path of the ball, the loft angle of the planar striking surface with respect to the ball matches the preselected loft angle, and the lie of the club from toe to heel is balanced.

25. A set of perimeter weighted golf club irons having a plurality of clubs, each club having a distinct loft, and each club having a club head comprising a shaft having a grip and a perimeter weighted head having:

a) a sloped-back club face having a leading bottom edge, a trailing top edge, and toe and heel portions of substantially the same height joining said bottom and top edges and defining a planar striking surface of substantially rectangular configuration and having a preselected loft angle;

b) a sole extending rearwardly from said leading bottom edge of said club face, said sole progressively becoming wider from heel to toe;

c) a top planar surface of substantially uniform width extending from toe to heel and rearwardly from said trailing top edge, wherein said top planar surface and said planar striking surface of said club face define an angle between them equal to said preselected loft angle for said planar striking surface plus 90 degrees, and wherein said preselected loft angle is preselected from the group consisting of irons 1 through 9, a pitching wedge, a gap wedge, a sand wedge, and a lob wedge;

d) a back surface having a lower peripheral portion intersecting said rearwardly extending sole, said lower peripheral portion progressively becoming thicker from heel to toe and providing substantial peripheral weight progressing from heel to toe, an upper peripheral portion of substantially reduced weight compared to said lower portion and intersecting said rearwardly extending top planar surface and defining a rear sighting edge rearwardly extended from said trailing top edge and extending from toe to heel parallel to said planar striking surface of said club face for adjusting said striking surface perpendicular to the intended path of the ball, wherein said top planar surface is wider than the smallest distance between said club face and said back surface, and wherein said upper and lower portions of said back surface define a cavity therebetween that said top surface overhangs; and e) a hosel extending upwardly from said heel adjacent said sole and forward from said club face.

26. A head for a golf club iron comprising:

a) a sloped-back club face having a leading bottom edge, a trailing top edge, and toe and heel portions of substantially the same height joining said bottom and top edges and defining a planar striking surface of substantially rectangular configuration and having a preselected loft angle;

b) a sole extending rearwardly from said leading bottom edge of said club face;

c) a top planar surface of substantially uniform width of about 5 mm or more extending from toe to heel and rearwardly from said trailing top edge;

d) a back surface having a lower portion intersecting said rearwardly extending sole and an upper portion intersecting said rearwardly extending top planar surface and defining a sighting edge rearwardly extended from said trailing top edge and extending from toe to heel parallel to said planar striking surface of said club face for adjusting said striking surface perpendicular to the intended path of the ball, said top planar surface being wider than the smallest distance between said club face and said back surface; and e) a hosel extending from said heel.

* * * * *